US010898820B2

(12) United States Patent
Rieber

(10) Patent No.: US 10,898,820 B2
(45) Date of Patent: Jan. 26, 2021

(54) COMPACT MULTIPLE GABLE HOUSE DESIGN AND ASSEMBLY

(71) Applicant: KidKraft, Inc., Dallas, TX (US)

(72) Inventor: Frederick Rieber, Dallas, TX (US)

(73) Assignee: KIDKRAFT, INC., Dallas, TX (US)

( * ) Notice: Subject to any disclaimer, the term of this patent is extended or adjusted under 35 U.S.C. 154(b) by 0 days.

(21) Appl. No.: 16/603,149

(22) PCT Filed: Apr. 4, 2018

(86) PCT No.: PCT/US2018/026102
§ 371 (c)(1),
(2) Date: Oct. 4, 2019

(87) PCT Pub. No.: WO2018/187483
PCT Pub. Date: Oct. 11, 2018

(65) Prior Publication Data

US 2020/0030710 A1 Jan. 30, 2020

Related U.S. Application Data

(60) Provisional application No. 62/481,420, filed on Apr. 4, 2017.

(51) Int. Cl.

| | |
|---|---|
| ***E04H 1/12*** | (2006.01) |
| ***A63H 33/00*** | (2006.01) |
| ***E04B 1/343*** | (2006.01) |
| *A63H 3/52* | (2006.01) |

(52) U.S. Cl.
CPC ..... *A63H 33/008* (2013.01); *E04B 1/34321* (2013.01); *E04H 1/12* (2013.01); *A63H 3/52* (2013.01)

(58) Field of Classification Search
CPC . A63H 3/00; A63H 3/52; A63H 33/00; A63H 33/008; A63G 31/00; A63B 2009/006
USPC ..... 472/136; 446/476, 478, 487, 488
See application file for complete search history.

(56) References Cited

U.S. PATENT DOCUMENTS

2013/0178299 A1* 7/2013 Kopp ..... A63G 9/00 472/136
2014/0315651 A1* 10/2014 Meister ..... A63H 33/008 472/136

* cited by examiner

*Primary Examiner* — Kien T Nguyen
(74) *Attorney, Agent, or Firm* — Jackson Walker LLP

(57) ABSTRACT

The present disclosure relates, according to some embodiments, to a playhouse comprising a plurality of walls comprising a plurality of wall elements, configured to be connected to a gable roof; and a gable roof; comprising a plurality of gables, wherein the gable roof is configured to be attached to the plurality of walls; and a plurality of roof modules, wherein the first roof module is configurable to be connected and adjacent to the second roof module, wherein each roof module comprises a plurality of roof panels and at least one hinge, wherein the first roof panel is adjacent to the second roof panel and is connected by the at least one hinge, wherein the gable roof is configured to be mounted on a plurality of gables, and wherein the playhouse is configurable to a packed configuration or an assembled configuration.

18 Claims, 7 Drawing Sheets

COMPACT MULTIPLE GABLE HOUSE DESIGN AND ASSEMBLY

CROSS-REFERENCE TO RELATED APPLICATIONS

This application claims priority to U.S. Provisional patent application No. 62/481,420 filed Apr. 4, 2017. The contents of the above are hereby incorporated in their entirety by reference.

TECHNICAL FIELD

The present disclosure relates to designs for playhouses and compact buildings, having multiple gables, and particularly, relates to a foldable roof, in some embodiments, having a compact configuration.

BACKGROUND

The designs of playhouses, dollhouses, and other compact buildings are constantly improving. As a result, playhouses have developed in different ways. In some cases, there may be a demand for improved playhouses having different floorplans and layouts, which may require specialized construction. There may also be a demand for playhouses having compact configurations, which may improve packing of the playhouses. Currently, the assembly of a playhouse or dollhouse may be difficult and time consuming for consumers and parents to assemble. Some factors which may contribute to the difficulty of assembly of playhouses may include playhouses having multiple small pieces which may be fastened together by multiple screws, nails, or other fasteners; thus, requiring the use of multiple screwdrivers, wrenches, hammers, and other tools to assemble the dollhouse or playhouse.

However, designers of playhouses, dollhouses, or compact buildings cannot simply eliminate the need for consumer-end assembly, since producing the playhouses in upstanding, three-dimensional, assembled forms would add constraints to the transport, storage, and display of the dollhouses or playhouses, thus increasing their cost. Playhouses may be shipped from factories to consumers, businesses, and warehouses, which creates the ever-increasing need for multiple embodiments which may provide for compact configurations, ideal for packing.

Further, designers may not be able to simply reduce the size of a playhouse without, in turn, reducing the amount of usable interior area, which would reduce the capacity for multiple children or children of larger sizes and ages to utilize the interior of the playhouse.

SUMMARY

According to some embodiments, the present disclosure relates to a playhouse which may comprise a plurality of walls and a gable roof. The plurality of walls may further comprise a plurality of wall elements. The walls may be configured to be connected to a gable roof at the top of the walls. The gable roof may comprise a plurality of gables and a plurality of roof modules. The gable roof may be configured to be attached to the plurality of walls at the top of the walls. The plurality of roof modules may comprise a first roof module and a second roof module. The first roof module may be configurable to be connected to the second roof module. The first roof module may be adjacent to the second roof module.

Each roof module may comprise a plurality of roof panels and at least one hinge. The plurality of roof panels may comprise a first roof panel and a second roof panel. The first roof panel may be adjacent to the second roof panel. The first roof panel may be configured to be connected to the second roof panel by the at least one hinge. The at least one hinge may be configurable to form a valley configuration of the roof the playhouse. The gable roof may be configured to be mounted on a plurality of gables. The playhouse may be configurable to a packed configuration or an assembled configuration.

A playhouse may comprise a gable roof and a plurality of walls. The gable roof may comprise a plurality of gables. The gable roof may be configured to be mounted on the plurality of gables. The gable roof may comprise a first roof module. The first roof module may comprise a first roof panel, a second roof panel, a first hinge, a first overlying portion, and a first underlying portion. The first roof panel may be configured to be connected to the second roof panel by the first hinge. The first hinge may be configurable to form a valley configuration of the roof of the playhouse.

A second roof module may comprise a third roof panel, a fourth roof panel, a second hinge, a second overlying portion, and a second underlying portion. The third roof panel may be configured to be connected to a fourth roof panel by the second hinge. A first overlying portion of a first roof module may be configured to be connected to the second underlying portion of the second roof module.

A third roof module may comprise a fifth roof panel, a sixth roof panel, a third hinge, a third overlying portion, and a third underlying portion. The fifth roof panel may be configured to be connected to the sixth roof panel by the third hinge. A second overlying portion of a second roof module may be configured to be connected to the third underlying portion of the third roof module.

A fourth roof module may comprise a seventh roof panel, an eighth roof panel, a fourth hinge, a fourth overlying portion, and a fourth underlying portion. The seventh roof panel may be configured to be connected to the eighth roof panel by a fourth hinge. A third overlying portion of a third roof module may be configured to be connected to the fourth underlying portion of the fourth roof module. The fourth overlying portion of the fourth roof module may be configured to be connected to a first underlying portion of a first roof module. A plurality of walls may comprise wall elements. Walls may be configured to be connected to a gable roof at the top of the walls. A playhouse may be configurable to be a packed configuration or an assembled configuration.

A first roof module may be configurable to be connected to a second roof module by an overlying portion of the first roof module and an underlying portion of the second roof module. The second roof module may be configurable to be connected to a third roof module by an overlying portion of the second roof module and an underlying portion of the third roof module. The third roof module may be configurable to be connected to a fourth roof module by an overlying portion of the third roof module and an underlying portion of the fourth roof module. The fourth roof module may be configurable to be connected to the first roof module by an overlying portion of the fourth roof module and an underlying portion of the first roof module.

A first roof module may be configurable to be connected to a second roof module by an underlying portion of the first roof module and an overlying portion of the second roof module. The second roof module may be configurable to be connected to a third roof module by an overlying portion of the second roof module and an underlying portion of the third roof module. The third roof module may be configurable to be connected to a fourth roof module by an underlying portion of the third roof module and an overlying portion of the fourth roof module The fourth roof module may be configurable to be connected to the first roof module by an overlying portion of the fourth roof module and an underlying portion of the first roof module.

A first roof module and a second roof module may be configured to be connected by a tongue-in-groove connection. The second roof module and a third roof module may be configured to be connected by a tongue-in-groove connection. The third roof module and a fourth roof module may be configured to be connected by a tongue-in-groove connection. The fourth roof module and the first roof module may be configured to be connected by a tongue-in-groove connection.

A first roof module and a second roof module may be configured to be connected by fasteners. The second roof module and a third roof module may be configured to be connected by fasteners. The third roof module and a fourth roof module may be configured to be connected by fasteners. The fourth roof module and the first roof module may be configured to be connected by fasteners.

A plurality of roof modules may be configurable to be a packed configuration. The packed configuration of roof modules may have a surface area of about one-fourth of the base area of the assembled configuration of a playhouse.

At least one hinge may comprise a living hinge. At least one hinge may comprise the same material as a roof panel. At least one hinge may comprise a flashing. At least one hinge may be configurable to be a valley of the roof of the playhouse. A first roof panel may comprise a first hinge-side edge and a second roof panel may comprise a second hinge-side edge. The first hinge-side edge of the first roof panel and the second hinge-side edge of the second roof panel may be configurable to be in contact with each other along the hinge in a valley configuration. At least one hinge-side edge of at least one roof panel may be beveled. A plurality of gables may comprise an even number of gables. A roof module may comprise an even number of roof modules. A wall element may comprise at least one door and at least one window.

BRIEF DESCRIPTION OF THE DRAWINGS

Exemplary embodiments will be more readily understood from the following detailed description, when read in conjunction with the appended drawings, in which.

DETAILED DESCRIPTION

The present disclosure relates to roof designs for a compact building having more than two gables, with a specific embodiment illustrated having four gables. The described designs may provide for easily assembled playhouses that may have roof panels that may be compactly packaged for shipping. The designs accomplish an attractive and realistic design.

According to some embodiments, a playhouse design may comprise a roof which may include roof panels which may connect in different ways. Two roof panels may be joined by a hinge to comprise a roof module. In some embodiments, roof modules may comprise a dual panel or a single panel design which may be used for all roof panels in a building having more than two gables. The roof modules may comprise a hinge, such as a living hinge, such that the roof panels which may comprise the roof modules may lie flat in packaging. Roof panels may be hingeably connected and folded to form the valley between two roof surfaces in an assembled building, such as a children's playhouse.

Roof panels may provide for a multi-gable roof, unlike a typical two-gable roof. This may provide for a design that may create dormer type configurations with valleys in the roof. Valleys in the roof, by virtue of the living hinges, may provide the rain gutter or flashing that allows the rain to drain well off of the roof. By effectively routing water off of the roof, it may be enabled to have actual dormers with windows that may let light into the building or playhouse.

Figure 1:
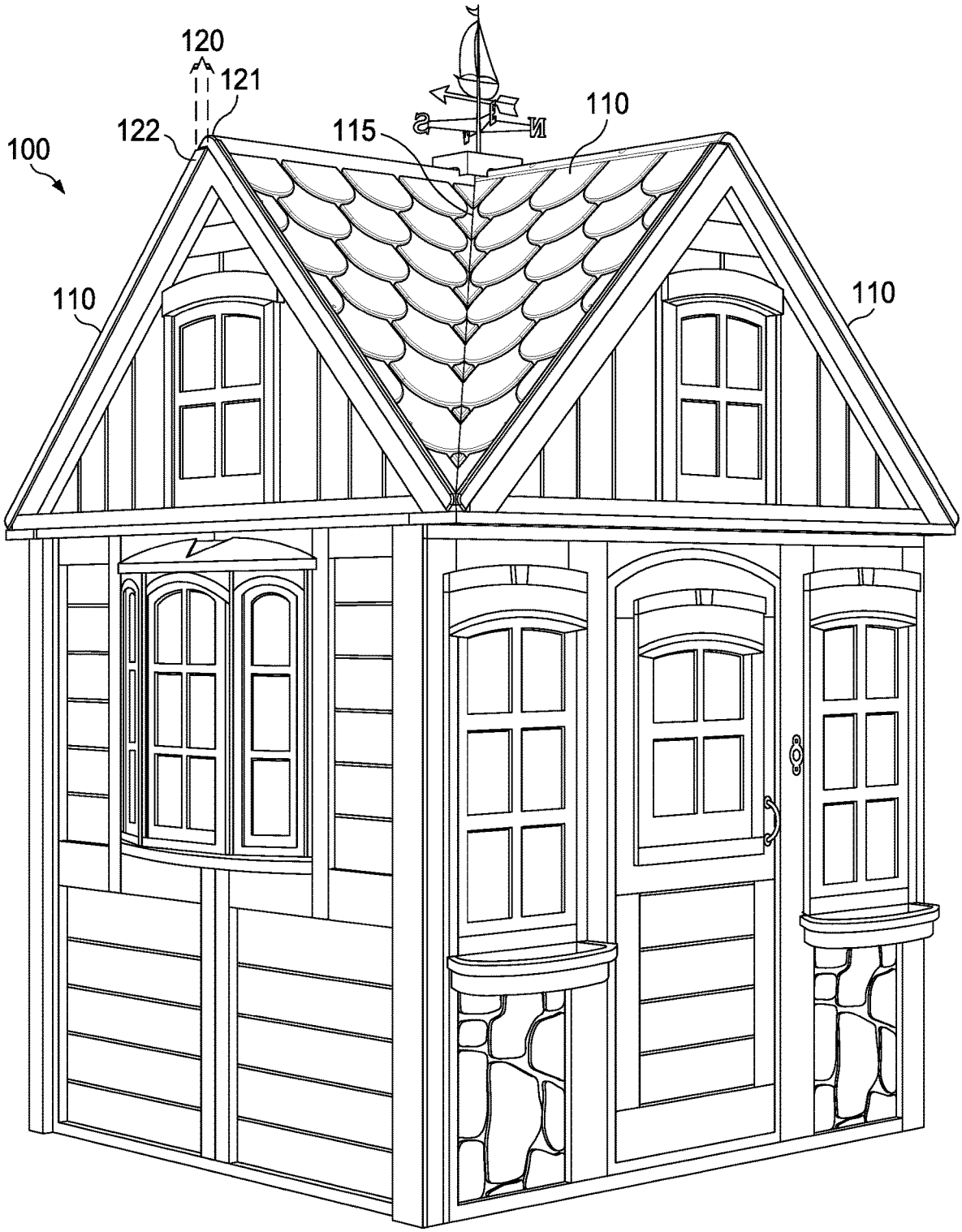
FIG. 1 illustrates a perspective of an assembled playhouse configuration according to specific example embodiments of the disclosure.

The present disclosure relates, according to some embodiments, to roof designs for compact buildings having more than two gables. FIG. 1 illustrates a perspective of an assembled playhouse configuration according to specific example embodiments of the disclosure. FIG. 1 discloses a four-gable house 100 made in accordance with the described roof panel design. The four-gable house 100 may comprise roof panels 110, a living hinge 115, an interconnected portion 120, an overlying portion 121, and an underlying portion 122. Some embodiments of may comprise walls which may include wall elements. Exemplary wall elements may comprise but are not limited to doors, windows, window boxes, shutters, and a doorbell. The roof panels 110 may have a living hinge 115, which may form a valley of the roof when assembled. There may be an interconnected portion 120 in which two adjacent roof panels 110 may connect to each other, and in the presently illustrated design there is provided an overlying portion 121 and an underlying portion 122 of the adjacent roof panel. The described interconnection is exemplary, and other connections such as tongue-in-groove or abutting or other interconnecting designs can be used.

In disclosed embodiments, these interconnecting portions are complementary to each other for adjacent roof panels, and the roof panels 110 can accordingly be multiplied around the roof in multiples of three, four, five, six, seven, or any other number of roof panels according to the building design. The adjacent roof panels 110 can be secured to each other by friction or other fastening pieces of the building 100, or they can be secured to each other by screws 130 (not shown, see FIG. 2), by post-and-pin connection, or through other types of fasteners or connection schemes.

A multi-gable roof design comprising a living hinge may provide for a reduced-stress-force mechanical structure in which the mechanical forces of roof panels 110 may be well-balanced and a minimum of forces may be placed upon any fasteners or mounting structures of the underlying building elements, such as the building walls and/or gables.

Figure 2:
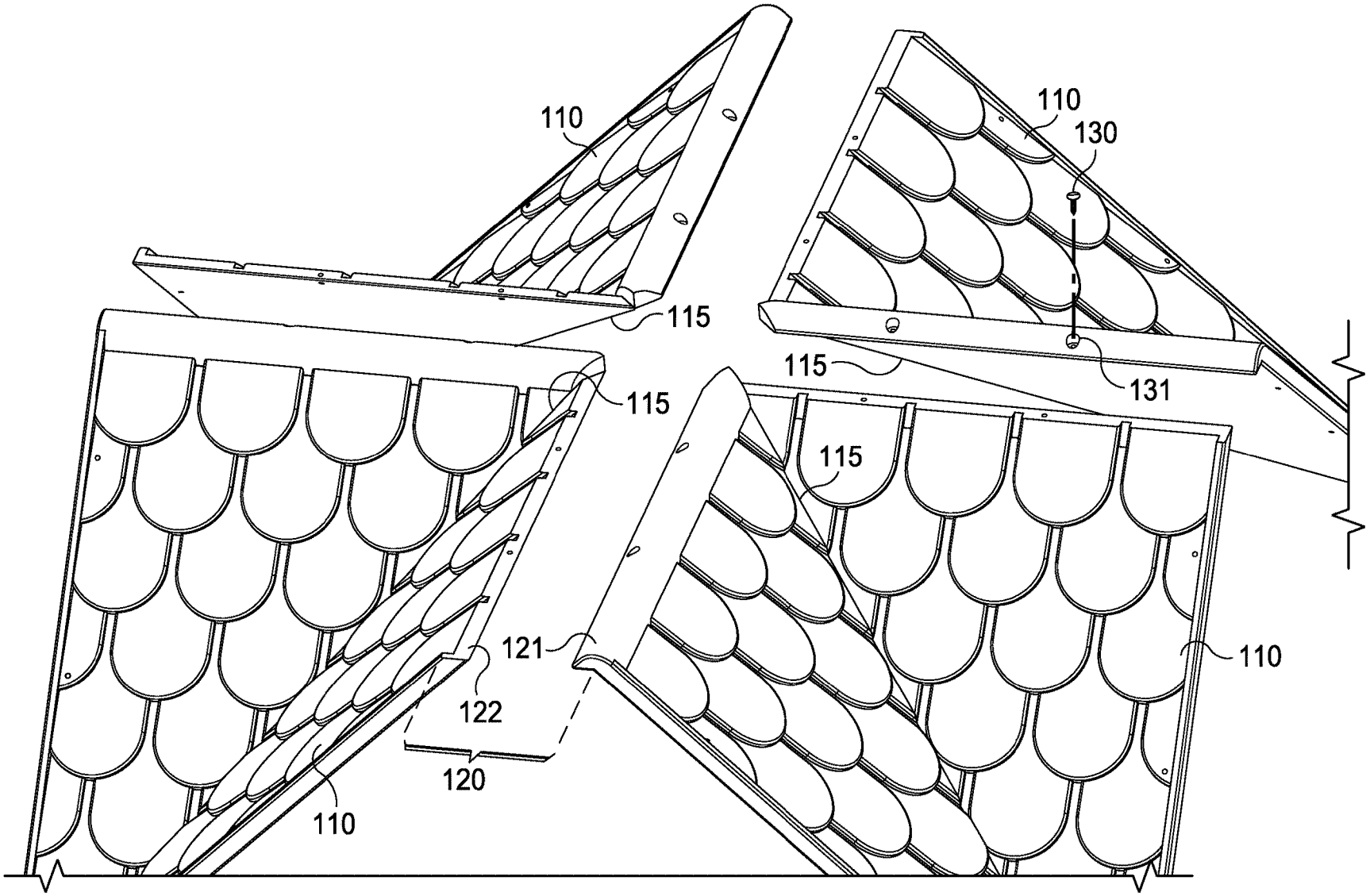
FIG. 2 illustrates a perspective of a playhouse roof according to specific example embodiments of the disclosure.

FIG. 2 illustrates a perspective of a playhouse roof according to specific example embodiments of the disclosure. A four-panel assembly, according to FIG. 2, may comprises four roof panels 110 which may interconnect as a roof of a building 100. In some embodiments, the roof panel 110 may comprise pre-formed holes 131 (such as holes for screws) that may provide for ease of placing fasteners 130. The roof panel 110 may be configured to be folded at the point of a living hinge 115. FIG. 2 illustrates how the four roof panels may interlock in such a way that each interconnecting portion 120 may include an overlying portion 121 and an underlying portion 122 between the adjacent roof panels, and that this scheme continues around the perimeter of the roof panels 110.

Figure 3:
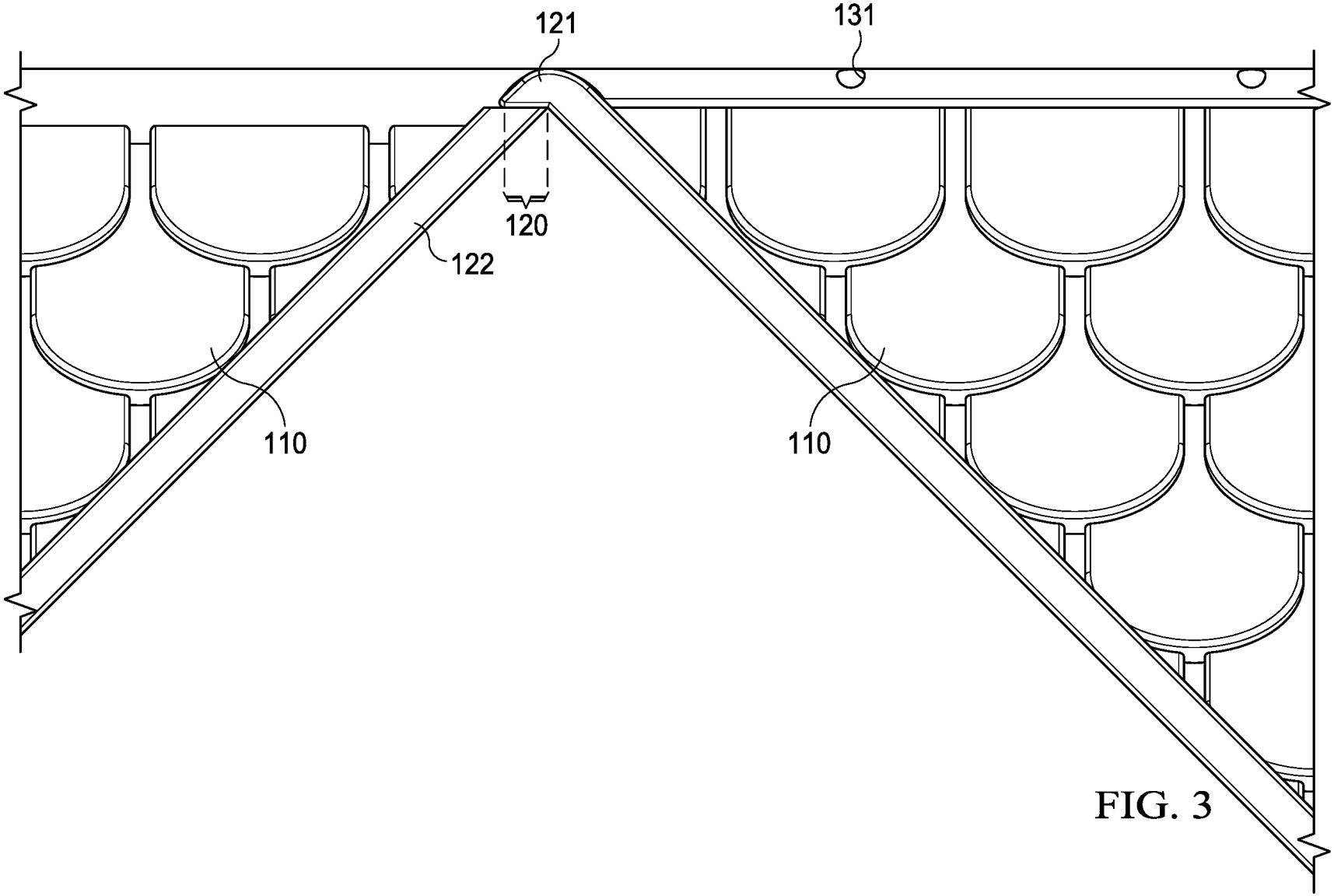
FIG. 3 illustrates a perspective of roof modules according to specific example embodiments of the disclosure.

FIG. 3 illustrates a perspective of roof modules comprising an interconnection portion 120 of two roof panels, including an overlying portion 121 and an underlying portion 122. Other designs are possible. The presently illustrated design advantageously provides for a locking arrangement in which the overlying portion 121 covers the underlying portion 122. In some embodiments, the locking arrangement may provide for leak prevention. For example, upon exposure of the roof to water (e.g., from rain), the water may be channeled down the top of the roof panels 110 and may be kept from leaking into the house 100 or building.

Figure 4:
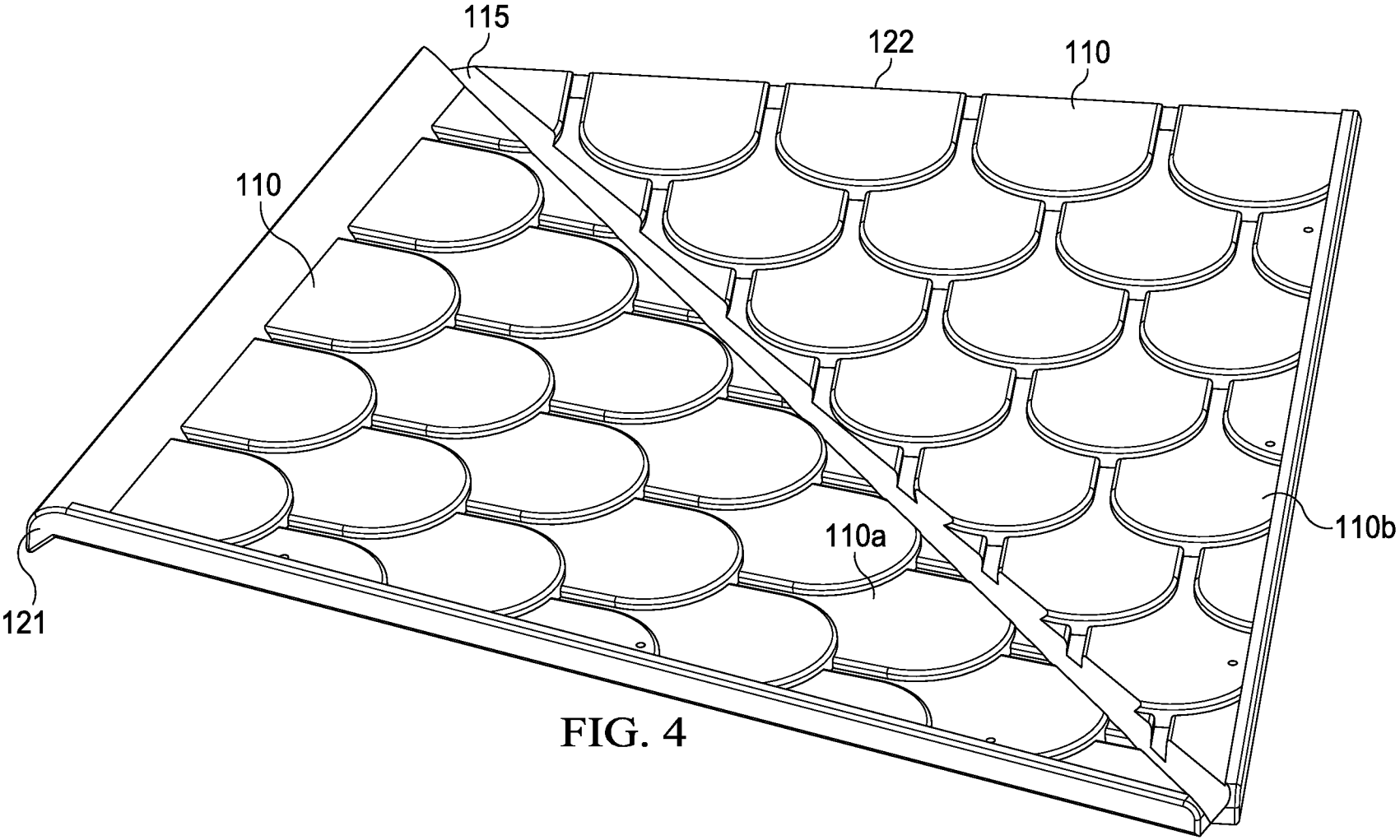
FIG. 4 illustrates a perspective of a roof module according to specific example embodiments of the disclosure.

FIG. 4 illustrates a perspective of a roof module according to specific example embodiments of the disclosure. FIG. 4 illustrates a shipping configuration of a roof panel 110 in which the roof panel 110 is in a "flat" configuration. A roof panel in a flat configuration may be folded. A roof panel in a folded configuration may desirably be assembled onto a building 100 or be configured to provide for a roof of a house or building. A left portion 110*a* and/or a right portion 110*b* may be on either side of a living hinge 115. A design of the living hinge may be chosen to provide sufficient strength or configuration efficiency for shipping and maintaining continuity of material before, during, and after assembly, but also with a sufficient flexibility as to be easily bent to form a valley on the building and to interconnect to other roof panels 110.

Figure 5:
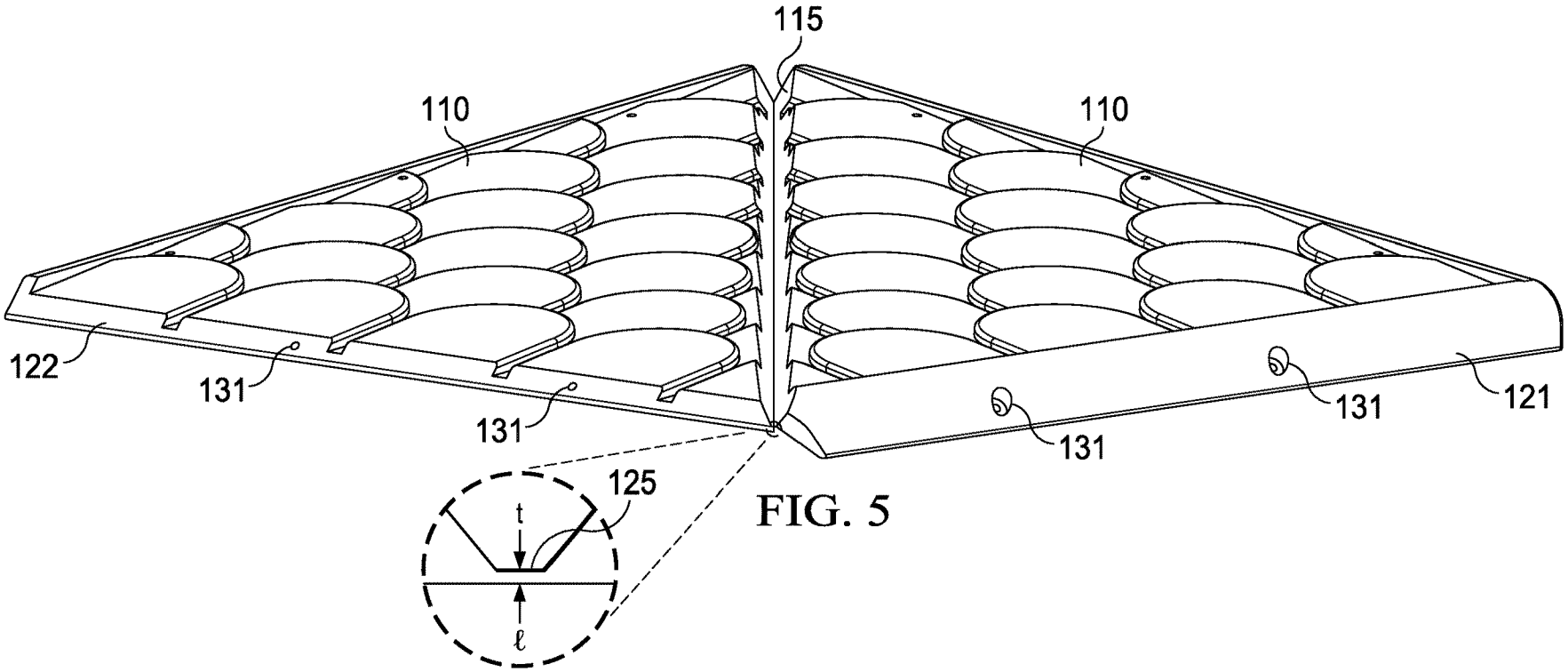
FIG. 5 illustrates a front perspective view of a roof module according to specific example embodiments of the disclosure.

FIG. 5 illustrates a perspective of a roof module according to specific example embodiments of the disclosure. The roof module may be configured into a "flat" roof panel 110 configuration. In a flat configuration, a roof module may comprise a "v-groove" of a living hinge 115. The v-groove may be designed, in some embodiments, such that the roof panel may fold until the two faces of the hidden hinge may contact each other, at which point the roof panel 110 may be folded such that the roof panel 110 may be configured for mounting upon a gable of the building 100. The roof panels 110 may be designed for easy assembly upon the building 100. A base of the v-groove of the living hinge 115 may comprise a thin portion 125 of material having a thickness ("t") of material such as 50 mils (thousandths of an inch) or 100 mils or 200 mils, or of a range between 50 and 100 mils or between 100 and 200 mils, where the thickness may be chosen based on the material properties of the roof panels 110 and/or the desired bending force and strength. A length ("l") of the thin portion 125 may also be adjusted according to material properties and desired bending force and strength in order to achieve the desired properties of the living hinge 115, and the shape of the thin portion 125 may be graduated such that it may be made thicker at the outer ends relative to the center of the thin portion.

Figure 6:
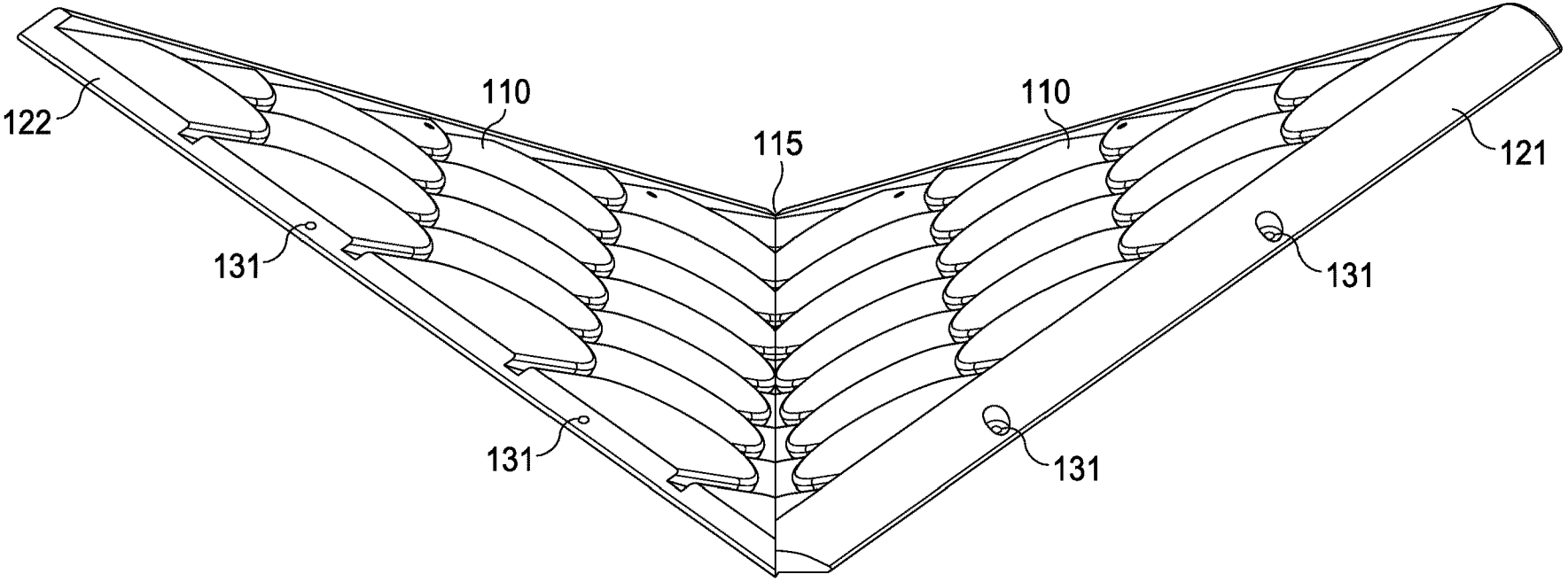
FIG. 6 illustrates a front perspective view of a roof module according to specific example embodiments of the disclosure.

In some embodiments, a roof panel 110 may comprise a wood panel assembly. A wood panel assembly may include an independent living hinge 115, triangular wood panels 110*a*, 110*b* (see FIG. 4), and a stud-like frame structure. Triangular wood panels 110*a*, 110*b* may be attached or fastened to a stud-like frame structure. Triangular wood panels 110*a*, 110*b* may comprise a pattern resembling asphalt shingles, or scalloped shingles, or the like. Triangular wood panels 110*a*, 110*b* may include crosscuts in order to simulate asphalt shingles. The living hinge 115 may comprise a plastic piece constructed separately from the roof panel 110. For example, the living hinge 115 may be injection-molded. In some embodiments, a living hinge 115 may be fastened between two assembled wood panels (e.g., triangular panels fastened onto a stud-like frame structure). The living hinge 115 may be fastened using studs from a stud-like frame structure. In some embodiments, a "v-groove" of the living hinge 115, may be achieved through bevels (e.g., wood bevels) on the opposing triangular wood panels 110*a*, 110*b*. In some embodiments, a "v-groove" may comprise a hinge-side edge of a first roof panel and a hinge-side edge of a second roof panel. In some embodiments, adjacent studs or hinge-side edges of adjacent roof panels may comprise precut bevels to form the v-groove. The same design principles for the living in terms of thickness and length, adapted according to differing mechanical demands, may be applied to the design of a separate living hinge or hinges 115 attaching the triangular wood panels 110*a*, 110*b*. FIG. 6 illustrates a front perspective view of the roof module, wherein the roof panels 110 are configured to be folded to have a valley. In the configuration wherein the roof module may form a valley, the roof module may be attached or assembled into a body of a house or building, as described above.

Figure 7:
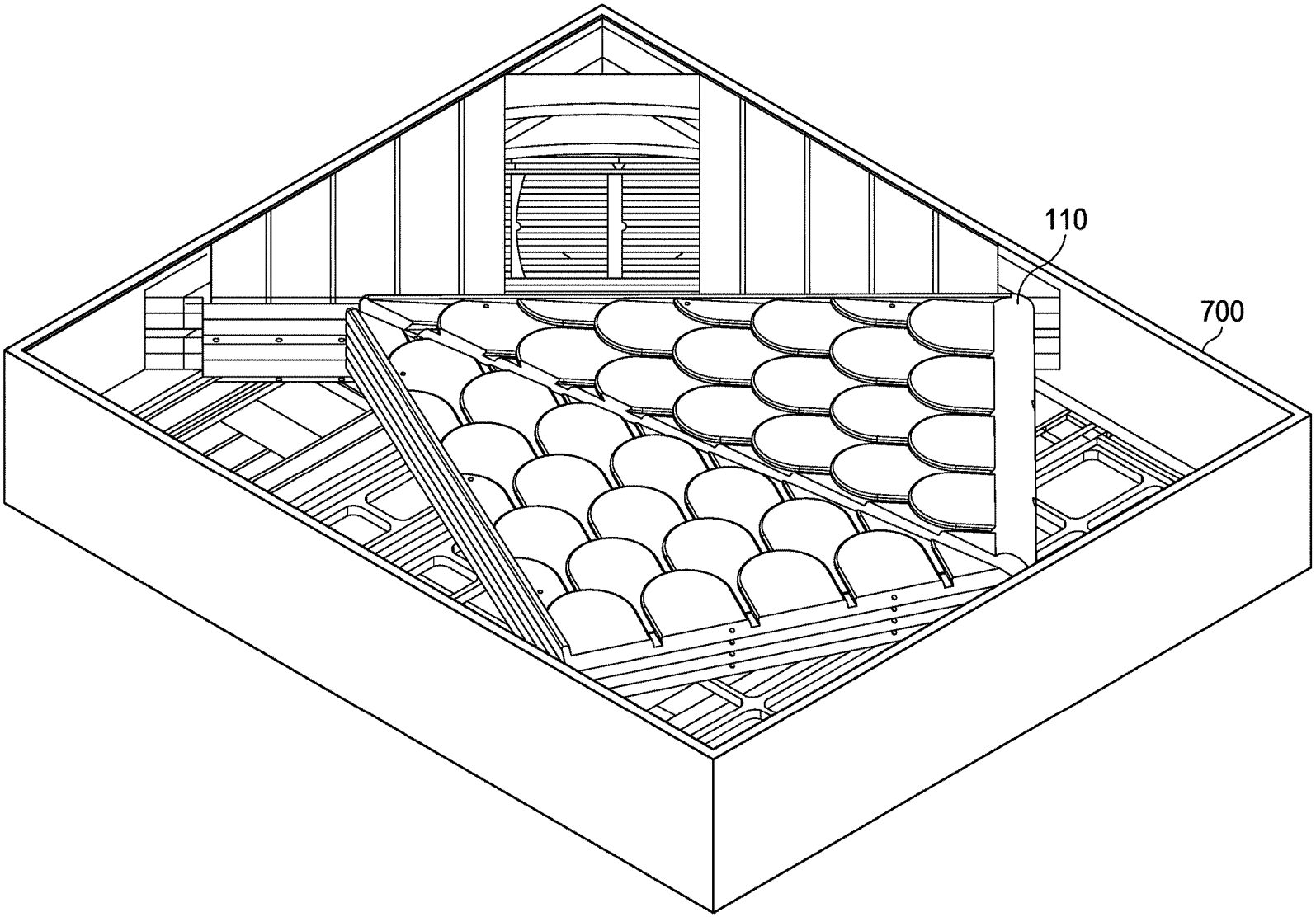
FIG. 7 illustrates an embodiment of a playhouse in a flat packed configuration according to specific example embodiments of the disclosure.

According to some embodiments, FIG. 7 illustrates an embodiment of a playhouse in a packed configuration having four roof modules in a flat configuration. The roof panels 110 may be packaged into a container 200 (e.g., shipping container or storing container). By using a multi-gable design according to embodiments disclosed herein, the packaged area of the roof panels 110 may be minimized relative to a two-gable building design, thereby desirably providing for an efficient packaging in addition to an attractive multi-gable design such as the one shown in FIG. 1. In some embodiments, the packaged surface area of the roof may be approximately one-fourth of the base area of the assembled configuration; in some cases, the base area of the assembled configuration may comprise the area enclosed by the walls. The described embodiments herein may provide improved aesthetics, packaging efficiency, and ease of assembly.

As will be understood by those skilled in the art who have the benefit of the instant disclosure, other equivalent or alternative designs, compositions, assemblies, and/or systems for compact multiple gable houses can be envisioned without departing from the description contained herein. Accordingly, the manner of carrying out the disclosure as shown and described is to be construed as illustrative only. A few preferred embodiments have been described in detail herein. It is to be understood that the scope of the invention also comprehends embodiments different from those described, yet within the scope of the claims.

For example, as discussed above the principles described herein may be used in buildings having three, four, five, six, or more gables. A material may be used for roof panels comprising one or more of various types of blow-molded thermoplastic materials. For example, a blow-molded thermoplastic material may comprise a Low Density Polyethylene (LDPE), a Medium Density Polyethylene (MDPE), a High Density Polyethylene (HDPE), a Polyethylene Terephthalate (PET), a Polypropylene (PP), a Polyvinyl Chloride (PVC) or a combination thereof. A roof panel may be formed of other types of plastics using other types of plastics molding such as injection molding of an Acrylonitrile Butadiene Styrene (ABS), an Acrylonitrile Butadiene Styrene Polycarbonate (ABS/PC), a High Density Polyethylene (HDPE), or other injection-molding-suitable plastics. Further, other, non-thermoplastic materials such as wood or paper materials may be used for the roof panels and/or other portions of the building. Various other modifications and combinations of the illustrative embodiments, as well as other embodiments of the invention, will be apparent to persons skilled in the art upon reference to the description. It is therefore intended that subsequent claims encompass such modifications or embodiments.

Persons skilled in the art may make various changes in the shape, size, number, and/or arrangement of parts without departing from the scope of the instant disclosure. For example, the position and number of roof panels may be varied. In some embodiments, roof panels may be interchangeable. Interchangeability may allow roof panels to be custom adjusted (e.g., by various number of panels). Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, and/or apparatuses, may exclude any other features or steps beyond those disclosed herein. Persons skilled in the art may make various changes in methods of preparing and using a composition, and/or assembly of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/− about 10%, depicted value+/− about 50%, depicted value+/− about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a device and/or system for compact multiple gable housing designs and assemblies may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A playhouse, the playhouse comprising:

(a) a plurality of walls comprising a plurality of wall elements, the walls are configured to be connected to a gable roof at the top of the walls; and (b) a gable roof; comprising:

(i) a plurality of gables, wherein the gable roof is configured to be attached to the plurality of walls at the top of the walls; and (ii) a plurality of roof modules comprising a first roof module and a second roof module, wherein the first roof module is configurable to be connected to the second roof module by an overlying portion of the first roof module and an underlying portion of the second roof module, wherein, the first roof module is adjacent to the second roof module, wherein the second roof module is configurable to be connected to a third roof module by an overlying portion of the second roof module and an underlying portion of the third roof module, wherein the third roof module is configurable to be connected to a fourth roof module by an overlying portion of the third roof module and an underlying portion of the fourth roof module, wherein the fourth roof module is configurable to be connected to the first roof module by an overlying portion of the fourth roof module and an underlying portion of the first roof module, wherein each roof module comprises a plurality of roof panels and at least one hinge, wherein the plurality of roof panels comprise a first roof panel and a second roof panel, wherein the first roof panel is adjacent to the second roof panel, wherein the first roof panel is configured to be connected to the second roof panel by the at least one hinge, wherein the at least one hinge is configurable to form a valley configuration of the roof the playhouse, wherein the gable roof is configured to be mounted on a plurality of gables, and wherein the playhouse is configurable to a packed configuration or an assembled configuration.

2. The playhouse according to claim 1, wherein the first roof module and the second roof module are configured to be connected by a tongue-in-groove connection, wherein the second roof module and the third roof module are configured to be connected by a tongue-in-groove connection, wherein the third roof module and the fourth roof module are configured to be connected by a tongue-in-groove connection, and wherein the fourth roof module and the first roof module are configured to be connected by a tongue-in-groove connection.

3. The playhouse according to claim 1, wherein the first roof module and the second roof module are configured to be connected by fasteners, wherein the second roof module and the third roof module are configured to be connected by fasteners, wherein the third roof module and the fourth roof module are configured to be connected by fasteners, and wherein the fourth roof module and the first roof module are configured to be connected by fasteners.

4. The playhouse according to claim 1, wherein the plurality of roof modules are configurable to be a packed configuration, wherein the packed configuration of the roof modules has a surface area of about one-fourth of the base area of the assembled configuration of the playhouse.

5. The playhouse according to claim 1, wherein the at least one hinge comprises a living hinge.

6. The playhouse according to claim 5, wherein the at least one hinge comprises the same material as the roof panels.

7. The playhouse according to claim 5, wherein the at least one hinge comprises a flashing.

8. The playhouse according to claim 1, wherein the first roof panel comprises a first hinge-side edge and the second roof-panel comprises at second hinge-side edge, wherein the first hinge-side edge of the first roof panel and the second hinge-side edge of the second roof panel are configurable to be in contact with each other along the hinge in a valley configuration.

9. The playhouse according to claim 8, wherein at least one of the first hinge-side edge or the second hinge-side edge of at least one roof panel is beveled.

10. The playhouse according to claim 1, wherein the plurality of gables comprises an even number of gables and the plurality of roof modules comprises an even number of roof modules.

11. The playhouse according to claim 1, wherein the plurality of wall elements comprise at least one door and at least one window.

12. A playhouse, the playhouse comprising:

(a) a gable roof comprising:

(i) a plurality of gables, wherein the gable roof is configured to be mounted on the plurality of gables;

(ii) a first roof module comprising a first roof panel, a second roof panel, a first hinge, a first overlying portion, and a first underlying portion, wherein the first roof panel is configured to be connected to the second roof panel by the first hinge, and wherein the first hinge is configurable to form a valley configuration of the roof of the playhouse;

(iii) a second roof module comprising a third roof panel, a fourth roof panel, a second hinge, a second overlying portion, and a second underlying portion, wherein the third roof panel is configured to be connected to the fourth roof panel by the second hinge, and wherein the first overlying portion of the first roof module is configured to be connected to the second underlying portion of the second roof module;

(iv) a third roof module comprising a fifth roof panel, a sixth roof panel, a third hinge, a third overlying portion, and a third underlying portion, wherein the fifth roof panel is configured to be connected to the sixth roof panel by the third hinge;

wherein the second overlying portion of the second roof module is configured to be connected to the third underlying portion of the third roof module; and (v) a fourth roof module comprising a seventh roof panel, an eighth roof panel, a fourth hinge, a fourth overlying portion, and a fourth underlying portion, wherein, the seventh roof panel is configured to be connected to the eighth roof panel by the fourth hinge;

wherein, the third overlying portion of the third roof module is configured to be connected to the fourth underlying portion of the fourth roof module; and wherein, the fourth overlying portion of the fourth roof module is configured to be connected to the first underlying portion of the first roof module; and (b) a plurality of walls comprising wall elements, wherein the walls are configured to be connected to the gable roof at the top of the walls, and wherein the playhouse is configurable to be a packed configuration or an assembled configuration.

13. The playhouse according to claim 12, wherein one or more of the hinges comprises a living hinge.

14. The playhouse according to claim 13, wherein, the first hinge comprises the same material of the first roof panel and the second roof panel, the second hinge comprises the same material as the third roof panel and the fourth roof panel, the third hinge comprises the same material as the fifth roof panel and the sixth roof panel, and the fourth hinge comprises the same material as the seventh roof panel and the eighth roof panel.

15. The playhouse according to claim 13, wherein, one or more of the living hinges comprises a flashing.

16. The playhouse according to claim 12, wherein one or more of the hinges is configurable to be a valley of the roof of the playhouse.

17. The playhouse according to claim 12, wherein the plurality of wall elements comprise at least one door and at least one window.

18. A playhouse, the playhouse comprising:

(a) a plurality of walls comprising a plurality of wall elements, the walls are configured to be connected to a gable roof at the top of the walls; and (b) a gable roof; comprising:

(i) a plurality of gables, wherein the gable roof is configured to be attached to the plurality of walls at the top of the walls; and (ii) a plurality of roof modules comprising a first roof module and a second roof module, wherein the first roof module is configurable to be connected to the second roof module by an underlying portion of the first roof module and an overlying portion of the second roof module, wherein, the first roof module is adjacent to the second roof module, wherein the second roof module is configurable to be connected to a third roof module by an overlying portion of the second roof module and an underlying portion of the third roof module, wherein the third roof module is configurable to be connected to a fourth roof module by an underlying portion of the third roof module and an overlying portion of the fourth roof module, wherein the fourth roof module is configurable to be connected to the first roof module by an overlying portion of the fourth roof module and an underlying portion of the first roof module, wherein each roof module comprises a plurality of roof panels and at least one hinge, wherein the plurality of roof panels comprise a first roof panel and a second roof panel, wherein the first roof panel is adjacent to the second roof panel, wherein the first roof panel is configured to be connected to the second roof panel by the at least one hinge, wherein the at least one hinge is configurable to form a valley configuration of the roof the playhouse, wherein the gable roof is configured to be mounted on a plurality of gables, and wherein the playhouse is configurable to a packed configuration or an assembled configuration.

* * * * *